United States Patent [19]

Pitt

[11] Patent Number: 5,072,561

[45] Date of Patent: Dec. 17, 1991

[54] PREFABRICATED LOUVER

[76] Inventor: William V. Pitt, 447 Champion Dr., Brownsville, Tex. 78520

[21] Appl. No.: 543,522

[22] Filed: Jun. 26, 1990

[51] Int. Cl.[5] ..... E06B 7/08

[52] U.S. Cl. ..... 52/473

[58] Field of Search ..... 52/473

[56] References Cited

U.S. PATENT DOCUMENTS

| | | | |
|---|---|---|---|
| 1,728,498 | 9/1929 | Mart | 52/473 |
| 3,120,036 | 2/1964 | Minds | 52/473 |
| 3,943,679 | 3/1976 | Dissinger | 52/473 |
| 4,374,693 | 2/1983 | Pitt | 52/309.11 |
| 4,429,498 | 2/1984 | Pitt | 52/204 |

FOREIGN PATENT DOCUMENTS

| | | | |
|---|---|---|---|
| 201715 | 8/1923 | United Kingdom | 52/473 |
| 1163661 | 9/1969 | United Kingdom | 52/473 |

*Primary Examiner*—James L. Ridgill, Jr.

[57] ABSTRACT

A prefabricated modular louver includes a pair of side walls or jams in generally upstanding parallel relationship to each other, a top wall, a bottom wall, and a plurality of slats between the jams in generally vertically spaced relationship to each other. Each slat has a transverse edge which is located by three locating bosses of each jamb or side wall.

31 Claims, 2 Drawing Sheets

PREFABRICATED LOUVER

BACKGROUND OF THE INVENTION

This invention relates to louvers of various descriptions designed for ease of field assembly, ease of field custom trimming, ease of field dimension modification, ease of replacement of any single damaged part, and ease of installation.

It is quite common in the engineering and construction field to order louvers for particular purposes, and many such louvers are custom built to a particular wall opening size. More often than not, between the time the louver blueprints and/or construction drawings are approved and the wall opening in a particular building or other such construction is completed, the dimensions of the louver and/or the wall opening are rarely identical and seldom completely compatible. Therefore, a louver or louver assembly fabricated in a factory miles away from the point of installation may not fit the prepared wall opening. Obviously, the latter results in a quandry. Usually, the wall opening is of a heavy construction, either structural steel, concrete or block, and cutting these to form a larger opening is almost out of the question. Even if the opening were framed by wood, the construction might be such as to preclude simply removing the framing and enlarging the size of the wall opening. Obviously, if the opening in the wall can not be changed to accommodate the louver, the louver must be field modified to accommodate the smaller opening. Generally, such field modification requires the disassembly of the louver, cutting components as need be, reassembling the components, and then joining the components to size the louver to now fit the opening or space that exist in the wall. Such field modification, disassembly, reassembly, etc. is extremely expensive and is not regarded by the louver manufacturer as compatible with good construction practice. Hence, the need of a modular or prefabricated louver or louver assembly which permits simple modification to meet variations in size conditions of a wall opening in the field would be highly advantageous both from a manufacturing and an installation standpoint. Thus, a prefabricated or modular louver which can be readily tailored in the field with little elase than those tools which are carried to and used in the field is extremely desirable.

It is also extremely desirable for such prefabricated louvers to be susceptible to shipment in knocked-down condition which lessens the size and bulk of the corresponding assembled counterpart. A prefabricated louver of 4'×4'×6" is rather large and bulky and presents packaging problems, high freight costs and expensive protective crating to prevent damage. However, if the components of the same size louver could be shipped in knocked-down condition, the size and bulk would be reduced, the cost of packaging would decrease, and freight costs would also lessen. The latter occurs simply because there is a volume penalty involved with most freight rates for shipping large size versus low weight. In other words, the penalty is essentially imposed because one is shipping "air," not mass. Therefore, if the louver assembly can be sent in knock-down form to its installation site, the freight would correspond to the cost of shipping the mass, not the exceedingly higher cost of shipping the volume of a corresponding sized but erected or assembled louver.

SUMMARY OF THE INVENTION

The present invention is directed to a louver which preferably is prefabricated, yet can be shipped in knocked-down form so that all components of the louver or louver assembly can be shipped in standard containers of relatively light weight at low cubic foot volume and correspondingly increase mass which achieves favorable freight rates. In actual practice this relates to nearly a 30% savings in freight rate to which is also added lower container costs.

From an installation standpoint, the modular or prefabricated knocked-down louver system can be assembled by a single person with ease because no single component which must be handled is heavier than ten pounds for a standard 4'×4'×6" louver. Accordingly, the modular or prefabricated louver can be shipped disassembled or knocked-down, can be readily assembled in the field, and the individual components are so constructed that any discrepancies from the predesigned louver size relative to the predesigned wall opening can be readily and easily tailored in the field.

In keeping with the present invention, the modular louver or louver assembly is formed of two side walls or jambs, an upper wall and a lower wall collectively defining a generally polygonal frame and a plurality of slats therewithin. Inner surfaces of the side walls carry a plurality of sets of bosses which are horizontally aligned and constitute mirror images of each other. Opposing bosses of the side walls locate transverse edge portions of each slat and additionally maintain a plurality of the slats in desired vertical spaced relationship and angular relationship to each other. The slats are held in position by front trim pieces which are readily assembled to and disassembled from the side walls. All of these components are constructed from relatively impermeable materials, such as polyester and epoxy resins reinforced by fiberglass fibers, flakes, mats, and/or rovings with external surfaces being coated with a polyester resin which creates a weather-proof, corrosion-proof and virtually indestructible louver irrespective of years of exposure to the elements. Furthermore, if any of the components have to be cut in the field, any exposed cuts can be readily field-coated with a quiok drying polyester resin, and the latter maintains the overall integrity of the previously cut louver component. Accordingly, a louver of this type can be inexpensively shipped to a construction site at moderate freight rates, assembled quickly at the site of utilization and installed simply and quickly. However, even field modifications requiring cutting and/or polyester resin coating of cut and exposed component portions can be done quickly with standard tools, such as a chop saw, and when thereby field modified, the time of installation is negligibly increased. Accordingly, the cost of manufacture, shipping, assembly, field modification (where necessary), and installation is relatively straightforward, simple and low cost from a labor standpoint.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENTS

A novel louver, louver assembly or louver system constructed in accordance with this invention is best illustrated in FIGS. 1 through 4 of the drawings as generally designed by the reference number 10.

The louver 10 is illustrated housed within a generally reotangular opening O of a building B which can be constructed from steel, cinder blocks or wood. The opening O can vary in size, and for purposes of this description, the opening O is assumed to be nominally 4'−0"×4'−0"×6" and, obviously, the exterior dimensions of the louver 10 are nominally identical thereto.

The louver or louver assembly 10 is of a modular, prefabricated construction which is designed to be shipped in knocked-down condition to the site or location of the building B and assembled/installed in the opening O thereof. Thus, the various components of the louver 10 which will be described more fully hereinafter can be packaged and shipped in low volume/high mass containers thereby reducing freight costs.

Figure 1:
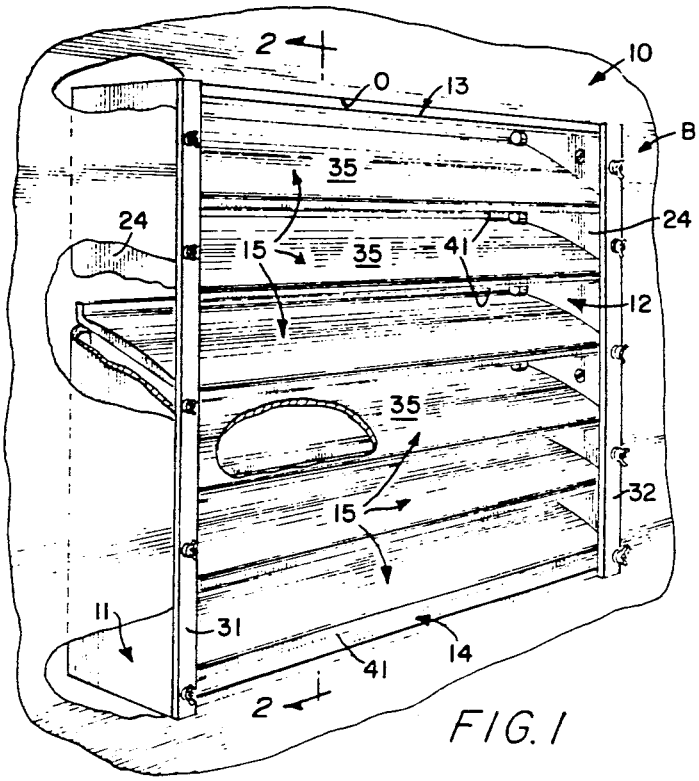
FIG. 1 is a front perspective view of a novel louver or louver assembly of the present invention, and illustrates the louver positioned within an opening of a building.

The louver or louver assembly 10 includes two identical side walls or jambs 11, 12, a top wall or head 13 and a bottom wall or sill 14. The side walls 11, 12 are in upstanding generally parallel relationship to each other, whereas the top wall 13 and the bottom wall 14 are generally normal to the walls 11, 12 (FIG. 1).

A plurality of identical louver slats 15 are disposed in generally parallel relationship to each other (FIGS. 1 and 2) inclined to the horizontal at approximately 45 degrees and in spanning relationship between side walls 11, 12.

A plurality of locating means in the form of bosses or projecting 21 through 23 are arranged in sets 20 along and projecting from each of the side walls 11, 12. The number of sets 20 of the locating means, bosses or projections 21 through 23 correspond to the number of slats 15 of the louver 10. For example, in FIG. 1 there are six slats 15 spanning the distance between the side walls 11, 12 and, therefore, six sets 20 of the locating means 21 through 23 are associated with each of the side walls 11 and 12. In addition, the bosses 2I through 23 of each set 20 of the side wall 11 are in axial alignment with corresponding bosses 2i through 23 of a corresponding set 20 of the side wall 12 and vice versa. Accordingly, in the assembled condition (FIG. 1) of the louver 10, the side walls 10, 12 and the plurality of sets 20 of bosses 21 through 23 are mirror images of each other.

Figure 3:
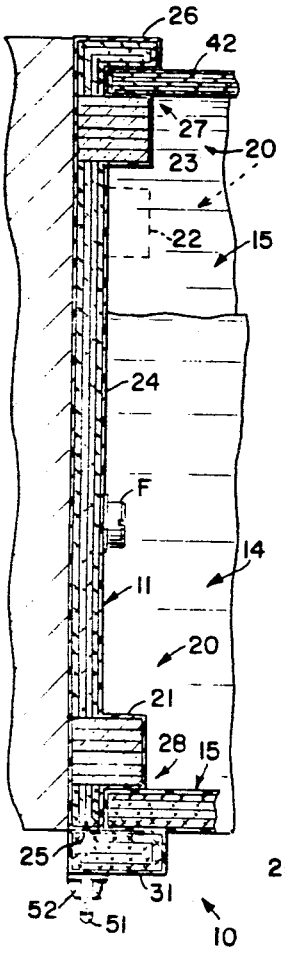
FIG. 3 is an enlarged cross-sectional view taken generally along line 3—3 of FIG. 2, and illustrates the manner in which front and rear longitudinal edges of one of the slats are located in sandwich relationship between an associated boss and an opposing component of the side wall.
Figure 4:
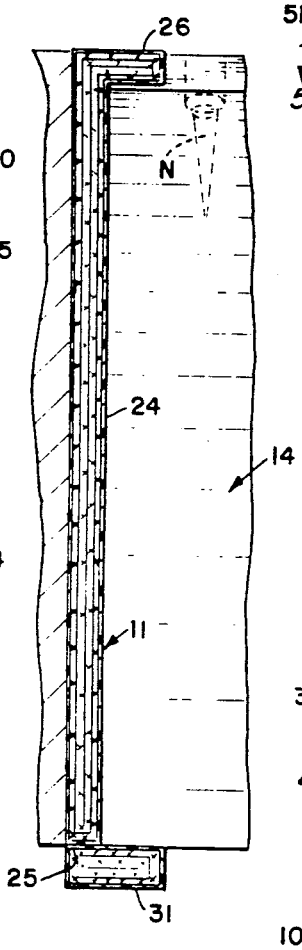
FIG. 4 is an enlarged cross-sectional view taken generally line 4—4 of FIG. 2, and illustrates a bottom wall or sill of the louver.

Each of the side walls 11, 12 includes a main upstanding wall portion 24 (FIG. 1) having a front vertical edge 25 and a rear vertical flange 26 (FIGS. 3 and 4). The rear vertical flanges 26 of the side walls 11, 12 are in opposed alignment with each other and define a rear slot 27 with each projection or boss 23 of each locating boss set 20. A narrow retaining wall or strip 31, 32 (FIG. 1) is secured to the front vertical edge 25 of the respective side walls 11, 12 in a manner to be described more fully hereinafter. However, the narrow retaining strips or walls 31, 32 define a forward slot 28 with each locating boss or projection 21 of each locating boss set 20. It is within the slots 27, 28 that portions of the slats 15 are located and retained, as will be described more fully hereinafter.

Each of the components 11 through 15, 21 through 23, 31 and 32 of the louver 10 is constructed from material which is resistant to exterior environment, particularly rain, snow, high humidity, etc. Thus, each of the latter components of the louver 10 are preferably constructed in accordance with the method set forth in U.S. Pat. No. 4,374,693 granted Feb. 22, 1983 to William V. Pitt and entitled Method of Manufacturing Atmospheric Resistant Doors. Though the latter patent describes a method of manufacturing doors, the method is equally applicable to the present invention and shall be described in conjunction with the manufacture of one of the slats 15 with reference first being made to FIG. 6 of the drawings.

Figure 6:
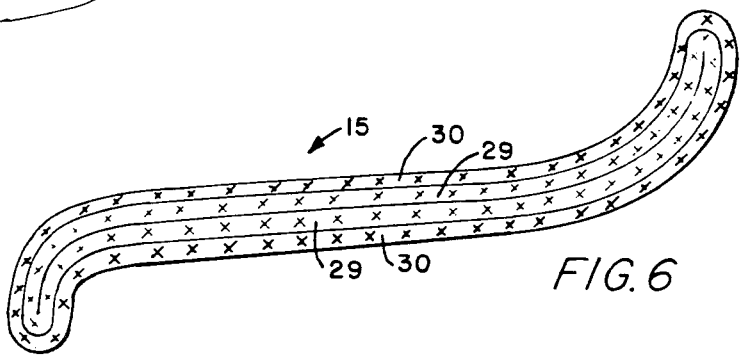
FIG. 6 is a highly diagrammatically transverse cross-sectional view of one of the slats of the louver, and illustrates the distribution of the glass reinforcement prior to being placed in a mold, the mold closed and a resin injected in the mold which, under heat and pressure, creates the transverse cross-sectional configuration of the slats of FIG. 2.

FIG. 6 illustrates one of the slats 15 in transverse cross section during its initial manufacture. A random glass fiber or fiberglass material in web form is wound into an inner tube 29 and other random glass fiber or fiberglass material in web form is also wound into an outer tube 30 exteriorly of the inner tube 29. Preferably, the wall thickness of the tubes 29, 30 are identical and the glass fibers of the tube 29 are oriented 90 degrees to the glass fibers of the tube 30, as is diagrammatically indicated by the "small x's" and "big X's," respectively. The axial or end-to-end dimension of the tubes 29, 30 corresponds to the distance between the inner surfaces (unnumbered) of the main upstanding wall portions 24 of the side walls 11, 12 in the assembled condition of the louver 10. The exterior diameter of the wound exterior fiberglass tube 30 is selected to correspond to slightly longer than the desired end-to-end transverse length of each finished slat 15. The longer exterior diameter dimension is required because the tubes 29, 30 are initially flattened and then are inserted into the cavity of a mold whose surfaces correspond to the exterior surfaces of the slats 15 of FIG. 2. The interior cavity of the mold is coated with a polyester resin, such as Gel-Kote, and the fiberglass tubes 29, 30 are compressed in the mold taking the shape of the interior cavity thereof. The polyester resin is then injected into the cavity of the mold filling all of the interstices of the webs 29, 30. The mold is subject to heat and pressure and the heat cures the resin resulting in a final molded slat 15 having a Gel-Kote exterior coating 47 defining an exterior surface 46 of each slat 15 and the resin impregnated webs 29 30 rigidified by the solidification of the injected resin under the influence of the heat reaction. The final cross-section of each slat 15 is generally symmetrical, except for a slight difference in upper and lower surface configuration, as will be described more fully hereinafter.

Figure 7:
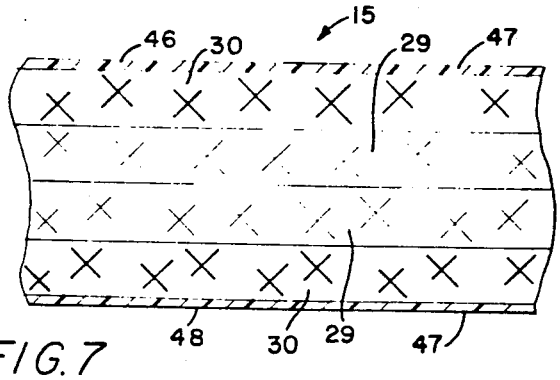
FIG. 7 is an enlarged cross-sectional view of the encircled portion of FIG. 2, and illustrates the final symmetrical cross-sectional construction of one of the slats.

The final configuration of each slat 15 is defined by a generally longitudinally extending main body 35 merging at junctures or radiuses 36, 37 with respective downwardly and upwardly oppositely directed longitudinal end portions 41, 42. Each longitudinal edge portion 42 (FIG. 3) is received in on of the rear slots 27 sandwiched between an associated projection 23 and the rear vertical flange 26. Each juncture 36 of each slat 15 also rests upon an associated boss 21 with the depending longitudinal edge portion 41 of each slat 15 being confined within the associated front slot 28 defined by the boss 21 and the associated retaining strip or wall 31, 32. The louver surface 48 of each slat 15 also rests upon the bosses 22 (FIG. 2), as will also be described more fully hereinafter. An upper surface 46 of each slat 15 is convexly curved and carries a Gel-Kote coating 47 thereon (FIG. 7), whereas a lower surface 48 of each slat 15 likewise carries the Gel-Kote coating 47 thereon but is essentially flat. The convex surfaces 46 provide aerodynamic air flow over the slats 15 across the face of the louver 10 generally towards the back of the louver 10 in a relatively highly efficient manner than heretofore provided by planar flat-surfaced conventional slats. Obviously, the application, field-of-use, etc. of the louver 10 varies with the intended flow of air.

Figure 5:
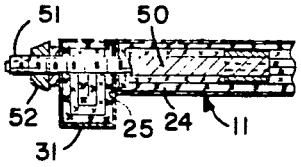
FIG. 5 is an enlarged fragmentary cross-sectional view taken generally along line 5—5 of FIG. 2, and illustrates one of a plurality of threaded bolts for securing a retaining wall to each of the side walls.

It is believed that the description of the manufacture of the slat 15 will enable one skilled in the art to manufacture all the components 11 through 14, 21 through 23, 31 and 32 in a generally identical manner. However, it will be noted that insofar as the side walls 11, 12 are concerned, these are provided with circular holes (unnumbered) into which epoxy-coated wound cylinders of fiberglass are inserted, as is most evident from FIG. 3 of the drawings. When inserted in contoured molds corresponding to the exterior configuration of the side walls 11, 12 which carry appropriate Gel-Kote coatings, the heat and pressure cures and rigidifies all of the wound fiberglass cylinders into the bosses 21 through 23 and rigidly bonds the same to the main upstanding wall portions 24 through the cured resins thereof. Also, prior to subjecting the side walls 11, 12 to the heat and pressure of a mold, threaded hanger bolts 50 (FIG. 5) are inserted partially into the main upstanding wall portions 24 with threaded ends 51 projecting beyond the front edges 25. The mold which receives the side walls 12 is relieved to accommodate the threaded end portions 51, and heat and pressure during the moldinq operation bonds the bolts 50 in the main upstanding wall portion 24 of each of the side walls 11, 12. The threaded ends 51 of the plurality of bolts 50 are passed through openings (not shown) of the narrow retaining walls 31, 32 and receive threaded wing nuts 52 for retaining the slats 15 in the assembled relationship show in FIG. 1, as will be described more immediately hereinafter. A variety of openings (unnumbered) may also be provided in any of the walls 11 through 14 during the molding thereof through whioh nails, nuts, bolts or similar fasteners F can be utilized to assemble the louver 10 in the opening O.

Instead of using the long fiberglass cylinders to form the bosses 21 through 23, the side walls 11, 12 are formed from fiberglass webs which are flattened in the manner described to the slats 15 and are inserted into a mold cavity which corresponds to a mirror image of each side wall 11, 12 including all of the bosses 21 through 23 thereof. The main cavity of the mold is filled by the flattened fiberglass tube or tubes which leaves the cavities defining the eventually formed bosses 21 through 23 open and accessible to the resin which is eventually pumped into th cavity when it is closed. Therefore, when the resin is pumped/injected into the cavity, it not only fills the interstices of the fiberglass flattened web, but also fills the cylindrical cavities corresponding to the bosses 21 through 23. Obviously, when the resin solidifies and the sides 11, 12 are each withdrawn from its respective mold, the side walls are essentially formed of rigidified fiberglass material and resin, whereas the bosses 21 through 23 are in situ molded and rigidified resin per se.

ON-SITE ASSEMBLY

It will be assumed that the components 11 through 15, 21 through 23, 31 and 32, the fasteners F and/or the wing nuts 52 have been shipped in knock-down condition to the site of the building B. Obviously, since essentially all of the components 11 through 15, 31 and 32 are nominally of 4' lengths, the container or package thereof is relatively small as compared to the assembled condition of the louver 10 of FIG. 1. This, obviously, results in the low cost freight rates heretofore noted.

It will also be assumed that the dimensions of the opening O and the components of the louver 10 are such that they do, in fact, match and no field modification (cutting) is required.

Figure 2:
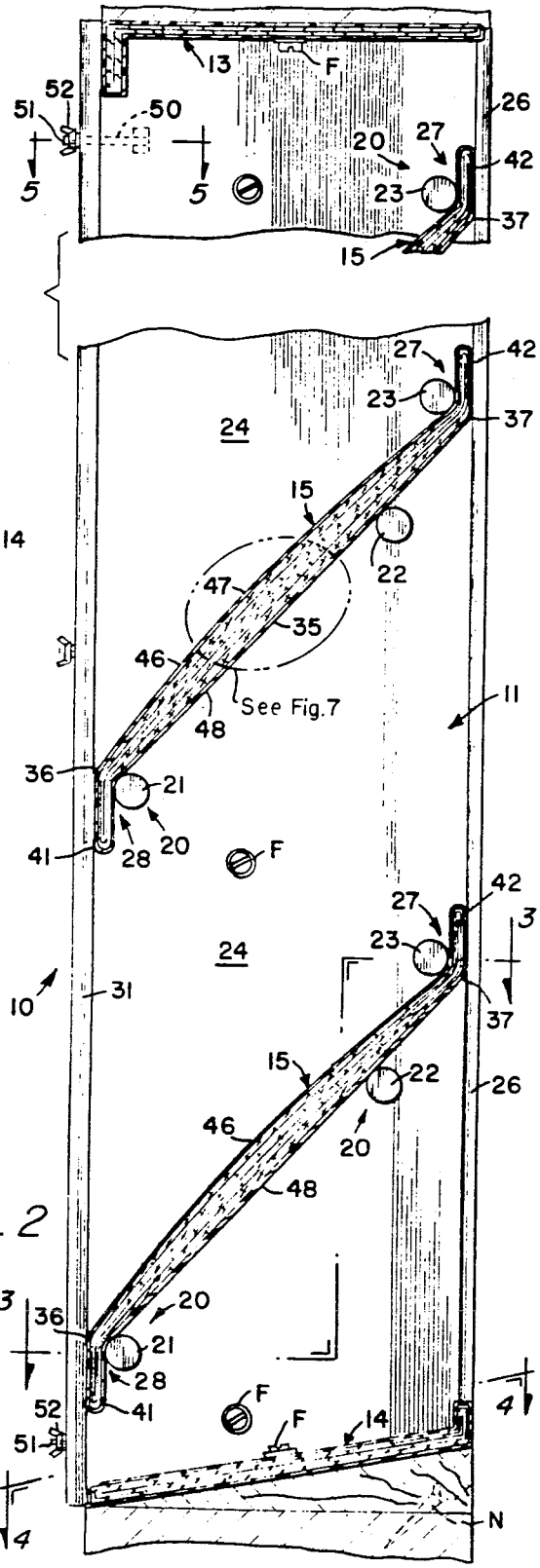
FIG. 2 is an enlarged fragmentary cross-sectional view taken generally along line 2—2 of FIG. 1, and illustrates a plurality of vertically sets of three locating bosses per set associated with each of two side walls of the louver and a slat interlockingly located relative to each of the sets of three bosses.

The side walls or jambs 11, 12 are connected to opposite sides of the opening O utilizing the fasteners F after, of course, assuring that the bosses 21 through 23 of each locating boss set 20 of the side wall 11 aligns with the bosses 21 through 23 of the opposite side wall 12. The head or top wall 13 can now be slid into the opening from front to back between the side walls 11, 12 and fastened to the upper frame (unnumbered) of the opening O by fasteners F, as is illustrated in FIG. 2. Next, the bottom wall or sill is slipped into position (FIG. 2) and secured by fasteners F. (One or more wedges W may be bolted or nailed by nails N to the framework [unnumbered] of the opening O to incline the lower wall or sill 14 so that any rain or water which might accumulate thereon will flow from back-to-front, right-to-left in FIG. 2.)

Each slat 15 is then slid into position between an aligned pair of the locating boss sets 20 of the opposite side walls 11, 12. This is accomplished by moving each slat 15 from front-to-back with the rear longitudinal edge 42 thereof leading in the direction of travel. The edge 42 and specifically the reduced edge portion 44 thereof is slid inwardly and upwardly into each associated rear slot 27 which entails not only an upward sliding movement of the longitudinal edge portion 42 but also a downward pivoting motion of the longitudinal edge portion 41 with the boss 23 essentially acting as the "pivot" point. In other words, each longitudinal edge portion 42 is both pushed or slid upwardly in each slot 27 while at the same time there is a bodily pivoting of each slat 15 about its associated boss 23 until the lower surface 48 of each slat 15 contacts its associated boss 22 and the juncture 36 contacts the boss 21. When all slats 15 have been thus positioned, the narrow retaining walls or strips 31, 32 are slipped upon the threaded ends 51 of the bolts 50 through the openings (unnumbered) in the retaining walls 31 after which the wing nuts 52 are threaded home (FIGS. 1 and 2). Appropriate caulking is applied between the opening O and louver 10 to seal the latter to the structure/framing of the building B, thus completing the assembly and installation of the louver 10 in approximately 30 minutes or less.

The narrow strips 31, 32 opposing the associated bosses 21 maintian the end portions 41 of the slats 15 in assembled relationship with the end portions 42 of the slats 15 similarly being maintained in confined relationship in the associated slots 27 between the bosses 23 and the vertical flanges 26.

If the opening O is undersized in vertical or horizontal directions or both, the ends of any of the components 11 through 15 can be cut by, for example, a conventional chop saw; raw cut edges thereafter resin coated for impermeability; and installation/assembly conducted in the manner heretofore described. If, for example, the opening O is one inch undersized widthwise (left-to-right in FIG. 1), the transverse edge portions (unnumbered) of each slat 15, the upper wall 13 and the lower wall 14 can be reduced in longitudinal length by this dimension. Once the cutting/notching of each slat 15 and cutting of the walls 13, 14 has taken place and the raw edges resin coated, the assembly/installation of the louver 10 can be achieved rapidly and the installation loses no integrity whatever to the environment. Obviously, height reduction can be equally achieved by cutting and/or notching the bottoms (preferably) or tops of the side walls 11, 12 and, as necessary, the narrow retaining walls or strips 31, 32. In this fashion the on-site adjustment followed by resin coating of cut edges assures integrity and impermeability to the environment while permitting the transition of air through the opening O in a highly efficient manner due to the convex upper surface 47 while, of course, limiting the inward transition of rain, birds, or simply assuring privacy from outside view.

Although a preferred embodiment of the invention has been specifically illustrated and described herein, it is to be understood that minor variations may be made in the apparatus without departing from the spirit and scope of the invention, as defined in the appended claims.

I claim:

1. A prefabricated louver comprising at least two side walls positioned in upstanding generally parallel relationship to each other, a plurality of slats positioned in generally vertical spaced relationship to each other and in spanning relationship between said side walls, each of said plurality of slats having opposite terminal end portions, a plurality of locating means arranged in a plurality of vertically spaced sets along each side wall for cooperatively interactingly locating an associated slat terminal end portion whereby said slats are located in vertical spaced relationship to each other, means for maintaining said locating means and terminal end portions in assembled relationship with each other, said plurality of sets of locating means are located generally an equal distance from each other along each of said side walls, said plurality of locating means of one side wall are positioned in mirror image relationship to said plurality of locating means of the other side wall, each slat further includes a generally longitudinally extending main body merging with opposite generally oppositely transversely directed longitudinal end portions, said plurality of locating means each include at least three locating bosses projecting laterally from each side wall at each of said plurality of sets, each slat further includes upper and lower surfaces, said three locating bosses of each set include an upper boss and a pair of lower bosses engaging said upper and lower slat surfaces respectively, each slat general longitudinally extending main body merging at a juncture with each fo said opposite longitudinal end portions, said upper boss and one of said pair of lower bosses being in engagement with said respective upper and lower slat surfaces at an associated one of each of said junctures, and said maintaining means defines a slot in conjunction with one of said upper boss and said one lower boss within which is received one of said longitudinal edge portions.

2. The prefabricated louver as defined in claim 1 wherein said slta main body includes an upper generally convex surface.

3. The prefabricated louver as defined in claim 1 wherein each slat further includes an upper generally convex surface and a lower generally flat surface.

4. The prefabricated louver as defined in claim 1 wherein said maintaining means defines a slot in conjunction with each of said upper bosses and each of said one lower boss within each of which is received an associated one of said longitudinal edge portions.

5. The prefabricated louver as defined in claim 1 wherein said maintaining means is defined by a narrow upstanding wall projecting generally transversely from each side wall in opposed relationship to each other, and each said slot is defined between one of said narrow projecting walls and each fo said upper bosses.

6. The prefabricated louver as defined in claim 1 wherein said maintaining means is defined by a narrow upstanding wall projecting generally transversely from each side wall in opposed relationship to each other, and each said slot is defined between one of said narrow projecting walls and each of said lower bosses.

7. The prefabricated louver as defined in claim 1 wherein said maintaining means is defined by a pair of narrow upstanding walls projecting generally transversely from each side wall in opposed relationship to each other, and each said slot is defined between one of each pair of narrow projecting walls and each of said upper bosses.

8. The prefabricated louver as defined in claim 1 wherein said maintaining means is defined by a pair of narrow upstanding walls projecting generally transversely from each side wall in opposed relationship to each other, and each said slot is defined between one of each pair of narrow projecting walls and each of said lower bosses.

9. The prefabricated louver as defined in claim 1 wherein said maintaining means is defined by a pair of narrow upstanding walls projecting generally transversely from each side wall in opposed relationship to each other, and each said slot is defined between each of said pair of narrow projecting walls and the associated upper and lower bosses.

10. A prefabricated louver comprising at leat two side walls adapted to be positioned in upstanding generally parallel relationship to each other, a plurality of slats adapted to be positioned in generally vertical spaced relationship to each other and in spanning relationship between said side walls, each of said plurality of slats having opposite terminal end portions, a plurality of locating means arranged in a plurality of vertically spaced sets along each side wall for cooperatively interactingly locating an associated slat terminal end portion whereby said slats are located in vertical spaced relationship to each other, emans for maintaining said locating means and terminal end portions in assembled relationship with each other; and each of said side walls, each of said plurality of slats and each of said plurality of locating means being constructed from a core of solidified resin impregnated permeable material and an exterior surface of polyester resin material resistive to chemical and corrosive attack.

11. The prefabricated louver as defined in claim 10 wherein each side wall center core includes groups of recesses, said locating means are bosses, and each boss center core is at least partially seated in an associated one of said recesses.

12. The prefabricated louver as defined in claim 10 wherein said plurality of sets of locating means are located generally an equal distance from each other along each of said side walls.

13. The prefabricated louver as defined in claim 10 wherein said plurality of locating means of one side wall are positioned in mirror image relationship to said plurality of locating means of the other side walls.

14. The prefabricated louver as defined in claim 10 wherein said plurality of sets of locating means are located generally an equal distance from each other along each of said side walls and plurality of locating means of one side wall are positioned in mirror image relationship to said plurality of locating means of the other side wall.

15. The prefabricated louver as defined in claim 10 wherein each slat further includes a generally longitudinally extending main body merging with opposite generally oppositely directed longitudinal end portions.

16. The prefabricated louver as defined in claim 10 wherein each slat further includes a generally longitudinally extending main body merging with opposite longitudinal end portions, and said slat main body includes an upper generally convex surface.

17. The prefabricated louver as defined in claim 10 wherein each slat further includes a generally longitudinally extending main body merging with opposite longitudinal edn portions, and said slat main body includes an upper generally convex surface and a lower generally flat surface.

18. The prefabricated louver as defined in claim 10 wherein said plurality of locating means each include at least two locating bosses projecting laterally from each side wall at each of said plurality of sets.

19. The prefabricated louver as defined in claim 10 wherein said plurality of locating means each include at least three locating bosses projecting laterally from each side wall at each of said plurality of sets.

20. The prefabricated louver as defined in claim 10 wherein said plurality of locating means each include at least two locating bosses projecting laterally from each side wall at each of said plurality of sets, each slat further includes upper and lower surfaces, and said two locating bosses of each set include an upper boss and a lower boss engaging said upper and lower slat surfaces respectively.

21. The prefabricated louver as defined in claim 20 wherein said maintaining means defines a slot in conjunction with one of said bosses within which is received one of said longitudinal edge portions.

22. The prefabricated louver as defined in claim 20 wherein said maintaining means defines a slot in conjunction with each of said bosses within each of which is received one of said longitudinal edge portions.

23. The prefabricated louver as defined in claim 10 wherein said plurality of locating means each include at least three locating bosses projecting laterally from each side wall at each of said plurality of sets, each slat further includes upper and lower surfaces, and said three locating bosses of each set include an upper boss and a pair oflower bosses engaging said upper and lower slat surfaces respectively.

24. The prefabricated louver as defined in claim 23 wherein said maintaining means defines a slot in conjunction with one of said bosses within which is received one of said longitudinal edge portions.

25. The prefabricated louver as defined in claim 23 wherein said maintaining means defines a slot in conjunction with each of said bosses within each of which is received one of said longitudinal edge portions.

26. The prefabricated louver as defined in claim 23 wherein each slat further includes a generally longitudinally extending main body merging at a juncture with opposite longitudinal end portions, and said upper and lower bosses engage said respective upper and lower slat surfaces at an associated one of each of said junctures.

27. The prefabricated louver as defined in claim 26 wherein said maintaining means defines a slot in conjunction with one of said bosses within which is received one of said longitudinal edge portions.

28. The prefabricated louver as defined in claim 26 wherein said maintaining means defines a slot in conjunction with each of said bosses within each of which is received one of said longitudinal edge portions.

29. The prefabricated louver as defined in claim 20 wherein each slat further includes a generally longitudinally extending main body merging at a juncture with generally oppositely directed longitudinal end portions, and said upper and lower bosses engage said respective upper and lower slat surfaces at an associated one of each of said junctures.

30. The prefabricated louver as defined in claim 29 wherein said maintaining means defines a slot in conjunction with one of said bosses within which is received one of said longitudinal edge portions.

31. The prefabricated louver as defined in claim 29 wherein said maintaining means defines a slot in conjunction with each of said bosses within each of which is received one of said longitudinal edge portions.

* * * * *

UNITED STATES PATENT AND TRADEMARK OFFICE

CERTIFICATE OF CORRECTION

PATENT NO. : 5,072,561

DATED : December 17, 1991

INVENTOR(S) : Pitt

It is certified that error appears in the above-indentified patent and that said Letters Patent is hereby corrected as shown below:

Column 1, line 47, "elase" should be -- else --.

Column 2, line 45, "quiok" should be --quick --.

Column 3, line 41, "reotangular" should be --rectangular --.

Column 4, line 9, "2i" should be --21--.

Column 5, line 16, "on" should be -- one --; and

Column 5, line 68, (last line) "whioh" should be --which --.

UNITED STATES PATENT AND TRADEMARK OFFICE

CERTIFICATE OF CORRECTION

PATENT NO. : 5,072,561

DATED : December 17, 1991

INVENTOR(S) : Pitt

It is certified that error appears in the above-indentified patent and that said Letters Patent is hereby corrected as shown below:

Claim 1, column 8, line 11, "fo" should be --of--.
Claim 2, column 8, line 21, thereof, "slta" should be --slat --.
Claim 5, column 8, line 36, thereof, "fo" should be -- of--.
Claim 10, column 8, line 64, thereof, "leat"should be --least--; and
Claim 10, column 9, line 7, thereof, "emans" should be --means --.
Claim 17, column 9, line 47, thereof, "edn" should be -- end --.
Claim 23, column 10, line 20, thereof, "oflower" should be --of lower --.

Signed and Sealed this

Fourteenth Day of September, 1993

*Attest:*

*Attesting Officer*

BRUCE LEHMAN

*Commissioner of Patents and Trademarks*